US005549233A

United States Patent [19]

Clauser

[11] Patent Number: 5,549,233

[45] Date of Patent: Aug. 27, 1996

[54] COUPON INSERTER

[75] Inventor: Donald E. Clauser, Evanston, Ill.

[73] Assignee: C. Joyce Witt, Barrington, Ill.

[21] Appl. No.: 370,779

[22] Filed: Dec. 23, 1994

Related U.S. Application Data

[63] Continuation of Ser. No. 10,759, Jan. 29, 1993, abandoned.

[51] Int. Cl.[6] ..... B65H 35/10; B65B 57/04; B65B 61/12

[52] U.S. Cl. ..... 225/100; 225/106

[58] Field of Search ..... 225/100, 106

[56] References Cited

U.S. PATENT DOCUMENTS

| | | | |
|---|---|---|---|
| 2,513,093 | 6/1950 | Hageman . | |
| 2,618,336 | 11/1952 | Davidson | 225/100 |
| 2,655,842 | 10/1953 | Baumgartner . | |
| 3,127,027 | 3/1964 | Roser et al. . | |
| 3,220,158 | 11/1965 | Roser et al. . | |
| 3,272,044 | 9/1966 | Obenshain . | |
| 3,281,143 | 10/1966 | Mommsen et al. . | |
| 3,302,946 | 2/1967 | Anderson . | |
| 3,332,324 | 7/1967 | Lehmacher et al. . | |
| 3,390,875 | 7/1968 | Beert et al. . | |
| 3,481,520 | 12/1969 | Pickering . | |
| 3,631,651 | 1/1972 | Kopp . | |
| 3,730,411 | 5/1973 | Brockmuller . | |
| 3,748,937 | 7/1973 | Long . | |
| 3,797,822 | 3/1974 | Anderson . | |
| 3,856,196 | 12/1974 | Bayne et al. . | |
| 3,881,645 | 5/1975 | Kopp . | |
| 3,929,326 | 12/1975 | Seragnoli . | |
| 3,991,924 | 11/1976 | Schueler . | |
| 4,039,181 | 8/1977 | Prewer . | |
| 4,060,168 | 11/1977 | Romagnoli . | |
| 4,069,957 | 1/1978 | Moffitt . | |
| 4,091,978 | 5/1978 | Graham, II | 225/100 |
| 4,118,022 | 10/1978 | Rayfield et al. . | |
| 4,179,113 | 12/1979 | Gallimore . | |
| 4,182,222 | 1/1980 | Stahl . | |
| 4,216,952 | 8/1980 | McInerny . | |
| 4,217,744 | 8/1980 | Mizutani . | |
| 4,222,511 | 9/1980 | Schueler . | |
| 4,261,497 | 4/1981 | Roetter et al. . | |
| 4,284,221 | 8/1981 | Nagel et al. . | |
| 4,323,230 | 4/1982 | Rising . | |
| 4,345,753 | 8/1982 | Marshall . | |
| 4,351,517 | 9/1982 | Neal et al. . | |
| 4,354,894 | 10/1982 | Lewis et al. . | |
| 4,375,189 | 3/1983 | Berner et al. . | |
| 4,385,537 | 5/1983 | Wolf . | |
| 4,412,631 | 11/1983 | Haker . | |
| 4,429,217 | 1/1984 | Hill et al. . | |
| 4,455,809 | 6/1984 | Dallaserra . | |
| 4,498,894 | 2/1985 | Kuckhermann . | |
| 4,516,765 | 5/1985 | Stocco et al. . | |
| 4,524,557 | 6/1985 | Silverman et al. . | |
| 4,530,200 | 7/1985 | Prewer . | |
| 4,651,983 | 3/1987 | Long . | |
| 4,658,564 | 4/1987 | Bell, Jr. et al. . | |
| 4,668,212 | 5/1987 | Kotani . | |
| 4,688,708 | 8/1987 | Irvine et al. . | |
| 4,696,145 | 9/1987 | Schmidt et al. . | |
| 4,717,043 | 1/1988 | Groover et al. . | |
| 4,929,226 | 5/1990 | Focke et al. . | |
| 4,982,337 | 1/1991 | Burr et al. | 225/100 |
| 5,010,240 | 4/1991 | Sheldon | 235/382 |
| 5,079,901 | 1/1992 | Kotsiopoulos . | |

FOREIGN PATENT DOCUMENTS

| | | |
|---|---|---|
| 53-38997 | 3/1978 | Japan . |
| 53-31067 | 8/1978 | Japan . |

*Primary Examiner*—Kenneth E. Peterson
*Assistant Examiner*—Sean A. Pryor
*Attorney, Agent, or Firm*—Leydig, Voit & Mayer, Ltd.

[57] ABSTRACT

An improved coupon inserter assembly receives a continuous supply of coupons and separates the forwardmost coupon and successive coupons from the web in a controlled fashion. The inserter assembly includes a pair of opposed feed rolls and opposed burst rolls for delivering the forwardmost coupon to a predispense position and deliver that coupon to a point of insertion. The feed rolls and delivery rolls are both driven from a first drive source during a feeding operation. The feed rolls are driven by the first source and the burst rolls are driven by a second drive source during a burst operation.

23 Claims, 4 Drawing Sheets

COUPON INSERTER

This is a continuation of application Ser. No. 08/010,759 filed on Jan. 29, 1993, now abandoned.

REFERENCE TO RELATED APPLICATIONS

This application is related to application Ser. No. 819,766, filed Jan. 13, 1992, which is a continuation of application Ser. No. 634,923, filed Dec. 21, 1990, now U.S. Pat. No. 5,079,901, which was a continuation of application Ser. No. 348,860, filed May 8, 1989, now abandoned and also related to application Ser. No. 582,331, filed Sep. 13, 1990. The disclosures of each of these applications are incorporated herein by reference.

FIELD OF THE INVENTION

This invention relates generally to apparatus and methods for inserting coupons into containers moving along a high volume handling system, and more particularly, the invention relates to coupon inserting apparatus and methods for feeding coupons provided in a continuous web in a first mode of operation and for separating the forwardmost coupon from the continuous web in a second mode of operation. The coupons may embody various sizes and shapes to be processed at relatively high speeds.

BACKGROUND OF THE INVENTION

As noted in the introductory portion of the specification of the aforesaid related applications, it is desirable to position coupons into passing containers in various commercial processing applications. In this way, for example, promotional materials such as discount coupons or prizes may be packaged with food or other items. Accordingly, the term "coupon" is used herein to include any type of insert, coupon, card, sheet, receipt, warranty, premium, and additionally, other three-dimensional novelty items that can be advantageously handled in accordance with the invention described hereinafter. Similarly, the term "container" is used in the broadest possible context to include containers such as boxes, tubs, cans and vessels of all kinds as well as other coupon receiving means which can be advantageously used with the present invention.

Heretofore, coupon dispensing systems in commercial settings have commonly required a stack of pre-cut coupons that are individually dispensed from a downwardly sloping channel, such as is shown in U.S. Pat. No. 4,530,200. In that system, pusher elements and advancing rollers coact to withdraw the forward most coupon from a pre-cut stack of coupons. The coupon is drawn into the downwardly sloping channel to a dispensing location. In other arrangements, for example in U.S. Pat. No. 4,179,113, a reciprocal vacuum head dispenses each coupon from a stack of pre-cut coupons and places the coupons in a conveyor system which transports the coupons to containers passing thereby.

The aforementioned related applications also disclose apparatus and methods for inserting coupons into moving containers. These applications disclose inserter machines that utilize a burster technique for separating a forwardmost coupon from a continuous web of coupons in timed relationship with a target container so that the forwardmost coupon is injected into the container. These machines are readily operable for successive insertion of coupons to accommodate various line processing speeds of the moving containers. In addition, such machines are relatively compact, and therefore may be readily placed at a plurality of locations along an integrated processing line without additional clutter, and are also readily transportable. Thus, such machines offer significant advantages, both in diminished real estate requirements, and in reliability in operation. However, such configurations are incapable of reliably processing coupons at insertion rates in excess of 300 coupons per minute. Likewise, such machines fail to provide adequate flexibility for handling three-dimensional and other specialty inserts.

SUMMARY OF THE INVENTION

Thus, the prior art coupon inserting systems now offer unsatisfactory performance, particularly in high speed commercial and other specialized applications. Likewise, they provide some degree of inflexibility. Accordingly, a principle object of the present invention is to generally overcome deficiencies of the prior art.

More particularly, it is an object of the present invention to provide improved performance in a coupon inserting system used in a materials handling line.

It is a more particular object of the present invention to provide a commercial quality coupon inserting system that adequately addresses high speed application requirements.

It is yet a further object of the present invention to provide improved insertion reliability, while at the same time, providing handling capability for three-dimensional and other novelty items, in a commercial setting.

The present invention provides these and other additional objects through an improved coupon inserter assembly that separates the forwardmost coupon from a continuous web and thereafter passes the coupon to a burst or dispensing location so that it may be injected into a container. The present invention further provides a method for using the same invention to achieve the desired result. Structurally, a preferred embodiment of the present invention comprises opposed feed rolls and opposed burst rolls located downstream from the feed rolls. The feed rolls operate, in a controlled fashion, to receive coupons from a continuous web and to advance the coupons to a burst location where the burst rolls engage the forwardmost coupon and a separable portion between the forwardmost coupon and the next succeeding coupon is positioned between the feed rolls and the burst rolls. In operation, the feed rolls move the forwardmost coupon into a nip formed by the burst rolls. The burst rolls engage the forwardmost coupon and in a burst operation, apply a separating tension along the separable portion while the web is engaged between the feed rolls.

A novel power delivery arrangement for rotating the feed rolls and the burst rolls includes a first controllable drive source that transmits torque to the feed rolls and, in a first mode of operation, the burst rolls. In this mode, the feed rolls and the burst rolls both rotate at the same tangential velocity to advance the web. In a second mode of operation, the first drive source is disengaged from the burst rolls. In this mode, a constant speed drive source is coupled to the burst rolls for rotating the burst rolls at a tangential velocity greater than that of the feed rolls such that the forwardmost coupon is separated from the next succeeding coupon.

A burst operation is based on receipt of a timing signal by control and timing circuitry, This timing signal is typically developed from a production line and is indicative of the movement of the containers to the dispensing location so that the coupons may be inserted into the containers as they pass thereby. In response, the control circuitry provides a control signal disengaging the burst rolls from the first drive source and for engaging the burst rolls with the second drive source to separate the forwardmost coupon. This timing signal may also be employed to control actuation of the first drive source. In addition, the first drive source is controlled in response to a coupon sensing signal developed from a location between the feed rolls and the burst rolls. A coupon sensor senses the lead edge of a next succeeding coupon upon completion of a burst operation and provides a sensing signal to control and timing circuitry. After separating the forwardmost coupon, the next succeeding coupon is delivered to the pre-dispense location.

DETAILED DESCRIPTION OF THE DRAWINGS

The above described and additional objects and features of the present invention may be further understood by reference to the following detailed description of the preferred embodiment, taken in conjunction with the accompanying drawings of which:

It should be understood that the drawings are not necessarily to scale and that in certain instances, details which are not necessary for an understanding of the present invention or which render other details difficult to perceive have been omitted.

While the invention will be described in connection with illustrative embodiments, it will be understood that they are not intended to limit the scope of the invention. On the contrary, it is intended to cover all alternatives, modifications and equivalents as may be included within the scope of the invention as defined by the appended claims.

DETAILED DESCRIPTION OF THE PREFERRED EMBODIMENT

Generally, the present invention provides an improved coupon inserter assembly for accommodating various sizes and shapes of coupons at a relatively high insertion rate. A device according to the present invention receives a continuous web of coupons and, upon the receipt of a signal, moves the forwardmost coupon in a controlled fashion in a feeding operation. In a bursting operation, the device separates the forwardmost coupon away from the continuous web, and dispenses the forwardmost coupon at a selected time into a rapidly moving container as it passes a dispensing location. The device of this invention is intended to be integrated into a full service processing system, and typically supplies successive coupons into the containers at a processing stage where the containers have been formed, may or may not yet be filled, and have not yet been closed. By way of example, the device of this invention may be adapted to supply coupons to bags of snack food containers, cereal boxes, bread sacks, or any other container using the teachings described herein. In addition, the invention may be used to supply seasoning pouches, condiments and other samples to the containers.

Figure 1:
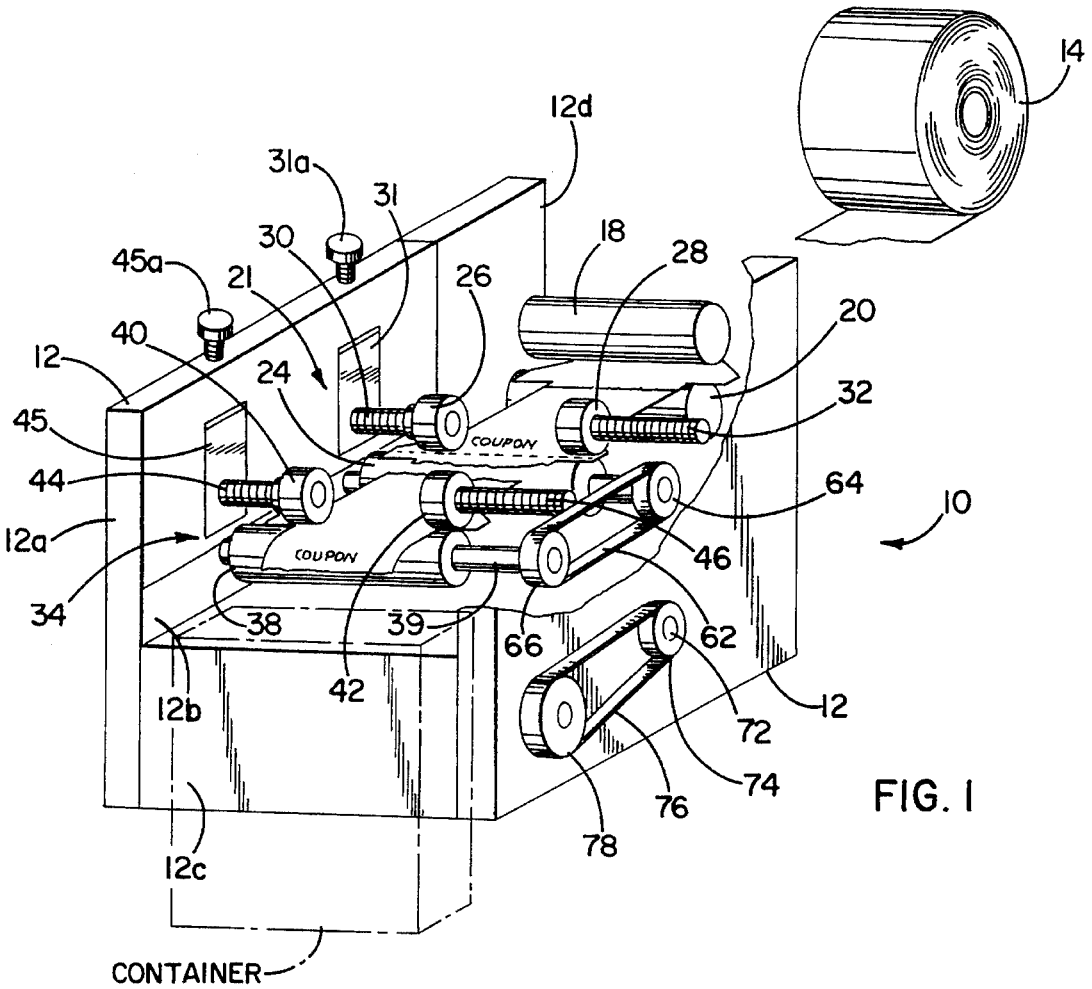
FIG. 1 is a perspective view of an illustrative embodiment of an apparatus embodying the principles of this invention.

FIG. 1 illustrates a coupon inserter assembly 10 according to this invention. The coupon inserter assembly 10 includes a housing 12 comprising a first removable housing module 12*a* and a second removable housing module 12*b*, each mounted in stacked relation with respect to a third housing module 12*c* for ready interchangeability of various of the componentry in the inserter assembly 10, as described in greater detail below. The inserter housing 12 may be mounted on a pedestal (not shown) adapted for pivotal and/or rotational movement to locate the coupon inserter assembly 10 in a desired orientation, such as, toward a processing line spaced proximate to a stream of moving containers. The containers are typically provided along a conveyor system or other handling system as would be understood by those skilled in the art.

A continuous web supply 14 of coupons may be packaged in a continuous circular reel, which is rotatably attached via a support 16 (see FIG. 2) proximate the inserter assembly 10. The web supply may also be provided in a fan-folded or a traverse fan-folded format as will be understood by those skilled in the art. It is contemplated that the invention may be utilized in conjunction with any number of coupon types. As an example, the web supply may be a continuous supply of paperboard or cardboard coupons physically connected to each other but separated by perforations or otherwise separated by weakened web portions which extends transversely of the web. In addition, the web supply may be a packaged premium wherein small prizes or the like are contained in plastic wrappers or pouches that are successively connected together by separable portions.

The coupon inserter assembly 10 preferably includes opposed tensioning rolls 18 and 20 rotatably mounted to a fourth removable housing module 12*d*. Tensioning roll 18 is an idler roll. Tensioning roll 20 is preferably connected to an adjustable resistance device of the type known to those skilled in the art thus providing tension between tensioning rolls 18 and 20 to insure uniformity in the web. The web supply is passed initially from the reel between tensioning rolls 18 and 20 and a feed roll subassembly (described below) to insure uniformity in the web and to minimize bending or folding of the web during further processing operations, as described below. Inasmuch as the housing module 12*d* is easily removed, the tensioning rolls 18 and 20 may optionally be removed for particular applications.

Figure 2:
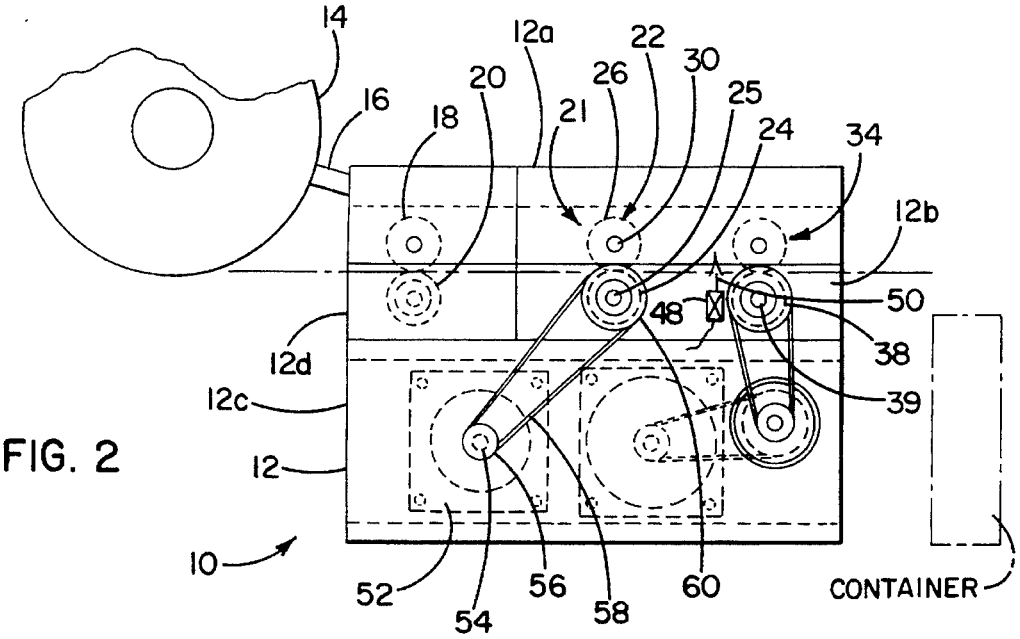
FIG. 2 is a side view of the coupon inserter assembly of FIG. 1 with portions removed for clarity.
Figure 3:
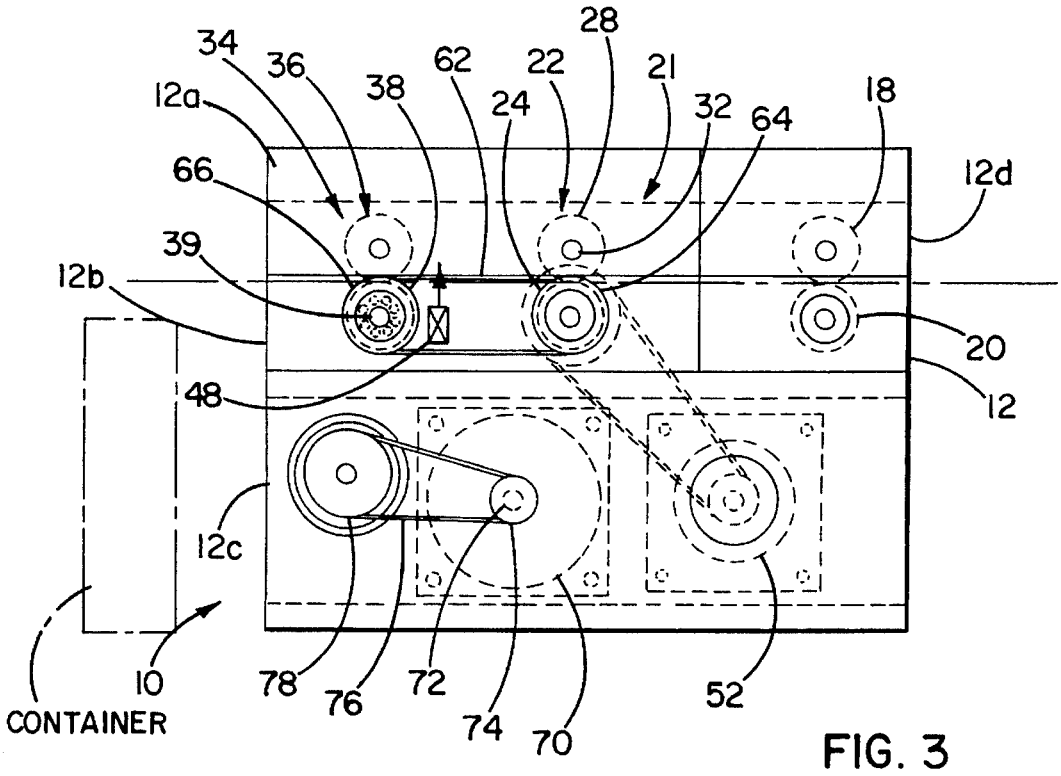
FIG. 3 is an additional side view of the coupon inserter of FIG. 1.

FIGS. 1 through 3 illustrate a feed roll subassembly 21 including an upper feed roll arrangement 22 and a lower feed roll 24 rotatably mounted to the second removable housing module 12*b*. As best seen in FIG. 1, the upper feed roll arrangement 22 comprises a first upper feed roll 26 and a second upper feed roll 28 axially spaced from upper feed roll 26. The upper feed rolls 26 and 28 are rotatably mounted to the housing module 12*a* via opposed shafts shown as threaded shafts 30 and 32, respectively and are freely rotatable relative to the housing module 12*a*. The threaded shafts 30 and 32 are received within complemental threaded housing blocks 31. This configuration enables relative axial adjustment between the upper feed rolls 26 and 28. On the other hand, the lower feed roll 24 is a driven via a drive shaft 25 (see FIGS. 2–3) and substantially traverses, and in most applications extends beyond, the width of coupons to be processed. The feed roll subassembly 21 operates in a controlled fashion to receive the coupon supply 14 in a nip formed between upper feed roll 26 and lower feed roll 24 and also between upper feed roll 28 and lower feed roll 24.

Inasmuch as the axial spacing of upper feed rolls 26 and 28 is readily adjustable, a coupon having a raised center portion and lateral sides which may be substantially flattened, such as prizes and the like contained in a wrapper, may be handled by engagement of the side portions of the coupon in the nip formed between the upper feed roll 26 and lower feed roll 24 on one side of the coupon and also between the upper feed roll 28 and the lower feed roll 24 on the opposed side of the coupon, as shown in FIG. 1. In this manner, small prizes or other three-dimensional premiums may be handled. Alternatively, the upper feed rolls 26 and 28 may be oriented in close axial spaced relation for handling substantially flat pieces.

In addition, the vertical spacing between upper feed rolls 26 and 28 and the lower feed roll 24 is also adjustable. As shown in FIG. 1, a pair of adjustment screws 31*a* are utilized to adjust the housing blocks 31 to thereby adjust the relative spacing between the upper and lower feed rolls.

Figure 4:
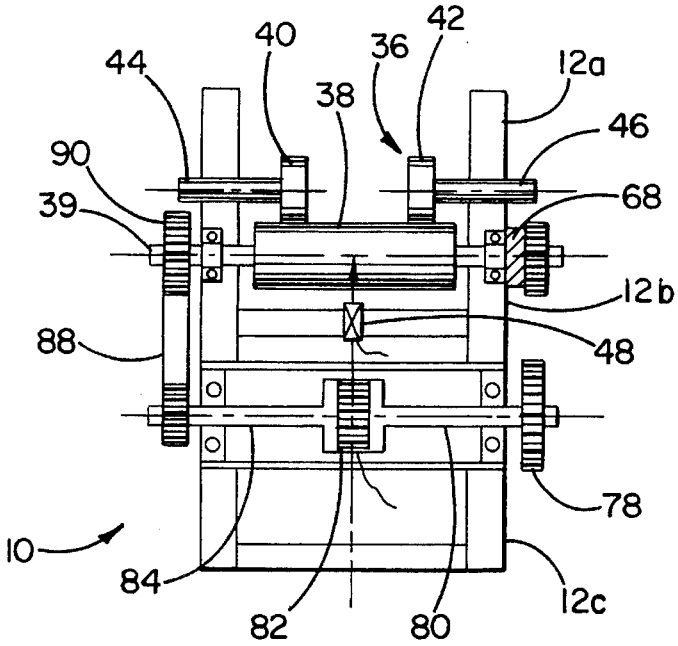
FIG. 4 is an end view of the coupon inserter assembly of FIGS. 1–3, looking from the output of the assembly.

FIGS. 1 through 4 also show a burst roll subassembly 34 including an upper burst roll arrangement 36 and a lower burst roll 38 that substantially traverses the coupon path. The lower burst roll 38 is mounted to housing module 12*b* and driven via drive shaft 39. In a first operating mode, the lower burst roll 38 is driven at an angular speed that is substantially the same as the lower feed roll 24. In a second operating mode, the burst roll 38 is driven at a substantially greater angular speed than the speed of feed roll 24 so that the forwardmost coupon is separated from the next succeeding coupon and passed, via rotation of the burst rolls, to a dispensing location. As best seen in FIG. 4, the upper burst roll arrangement 36 comprises a first upper burst roll 40 and a second upper burst roll 42 axially spaced from upper burst roll 40.

As with the upper feed rolls 26 and 28, the upper burst rolls 40 and 42 are rotatably mounted to the housing module 12*a* via adjustable threaded shafts 44 and 46, respectively. The threaded shafts, in turn, are received within threaded housing blocks 45. In this way, the relative axial placement of the upper feed rolls may also be readily adjusted to accommodate coupons having raised central portions. The vertical spacing between upper burst rolls 40 and 42 and lower burst roll 38 is also adjusted via adjustment screws 45*a*, which are coupled with housing blocks 45.

FIGS. 2 through 4 also show a photoelectric sensor 48 positioned relative to a coupon dispensing location between the feed roll subassembly 21 and the burst roll subassembly 34. As described in greater detail below, the leading edge of a coupon intercepts the light beam emitted by the photoelectric sensor (denoted by an arrow 50). In response, the photoelectric sensor 48 provides a sensing signal indicative of the detection of a coupon registered between the feed roll subassembly 21 and the burst roll subassembly 34.

The novel arrangement used to actuate the feed roll subassembly 21 and the burst roll subassembly 34 is best seen in conjunction with FIGS. 2 through 5. As shown in FIG. 2, a first drive source shown as a stepper motor 52 transmits torque via an output shaft 54 to a primary pulley 56. In the preferred embodiment, stepper motor 52 is a precisely controllable five phase stepper motor, Type PH599H-NAA(BA), manufactured by Oriental used in conjunction with a stepper motor driver, Type UDX5128NA, also manufactured by Oriental. An elastomeric belt 58 connects the primary pulley 56 to a secondary pulley 60 to transmit torque to the lower feed roll drive shaft 25. As best seen in FIG. 3, an elastomeric belt 62 connects the lower feed roll drive shaft 25 with the lower burst roll drive shaft 39 via pulleys 64 and 66.

As best seen in FIG. 4, an overrunning clutch 68 is also coupled to the burst roll drive shaft 39. By way of example, a wrap spring clutch, such as a PSI-2 series, manufactured by Warner is suitable for use as overrunning clutch 68. In a feed operation, the overrunning clutch 68 is engaged so that the stepper motor 52 transmits torque to the burst roll drive shaft 39 via belt 58 and via pulleys 56 and 60 and also via belt 62 and pulleys 64 and 66 (see FIGS. 2 and 3). The overrunning clutch 68 disengages during a burst operation to permit the burst roll drive shaft to be driven by a second source, as described in greater detail below.

As shown in FIG. 3, a constant high-speed electric motor 70 transmits torque via an output shaft 72 to a primary pulley 74. An elastomeric belt 76 couples the primary pulley 74 to a secondary pulley 78. As best seen in FIG. 4, the secondary pulley 78 transmits torque to an input shaft 80 of an electronic clutch 82. Preferably, clutch 82 is a radial electric wrap spring clutch, such as a Type EC75, manufactured by Reel Precision Mfg. Co.. To perform a burst operation, the electronic clutch is engaged for transmitting torque via a clutch output shaft 84 from the constant high-speed motor 70 to a pulley 86. An elastomeric belt 88 couples the clutch output to the lower burst roll shaft 39, via pulley 90. Such action disengages the overrunning clutch 68 to decouple the stepper motor 52 and lower burst roll shaft 39.

Figure 5:
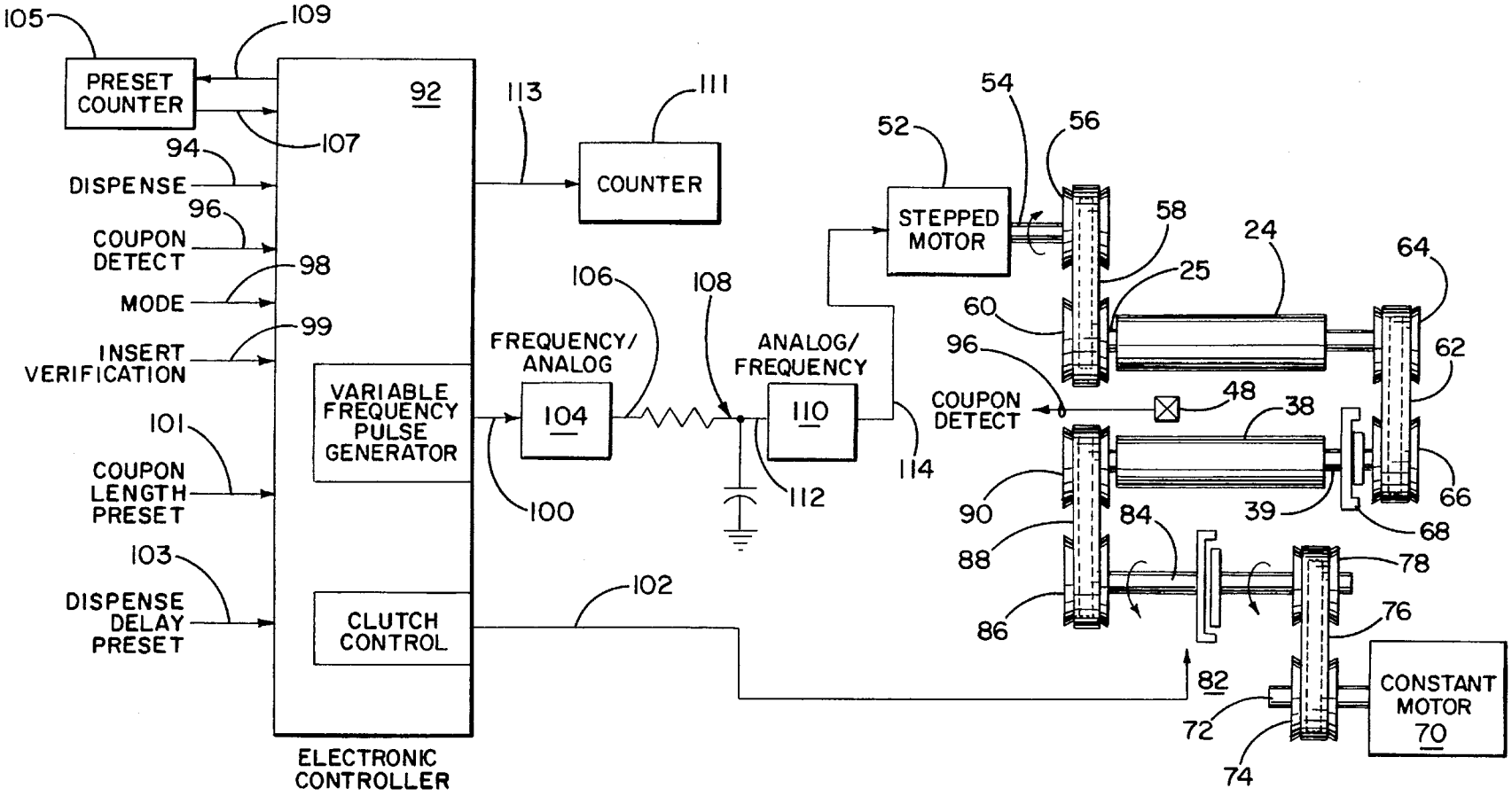
FIG. 5 is a simplified block diagram illustrating suitable control circuitry for the coupon inserter assembly of FIG. 1.

FIG. 5 illustrates one specific control system that may be utilized in practicing this invention. The electrical circuitry described hereinafter is typically located in a housing module remote from the inserter assembly and protected by suitable isolation circuitry, as will be understood by those skilled in the art. As shown in FIG. 5, an electronic controller 90 receives a coupon dispense signal on a line 94, a coupon detect signal on a line 96, an operation mode signal on a line 98, and optionally, an insert verification signal on a line 99. In addition, the electronic controller 90 receives a coupon length preset signal on a line 101, a coupon dispense delay preset signal on a line 103, and optionally, a total count signal from a counter 105 on a line 107. In the preferred embodiment, electronic controller 90 is a programmable logic controller, Type KV24, manufactured by Keyence. The electronic controller 92 operates in a logical fashion to provide a variable frequency pulse signal on a line 100 and a clutch control signal on a line 102.

The dispense signal supplied on line 94, the coupon length preset signal on line 101, and the dispense delay preset signal on line 103 are processed to determine the appropriate time to initiate a burst operation. The dispense signal on line 94 may be supplied from any number of external sources including existing product line control, a photoelectric sensor arrangement for detecting passing containers, proximity detection, an encoder scheme or any other suitable source. Likewise, this signal may be used by the controller 92 to determine the rate at which to feed the coupons during a feed operation. As noted above, the coupon detect signal on line 96 is generated by the photosensor 48 to register the position of the leading edge of the web. The mode signal on line 98 selects one of at least two available operating modes, namely a continuous feed mode where the feed rolls advance the web in a continuous fashion and an intermittent feed mode where the feed rolls accelerate and decelerate the web. The insert verification signal on line 99 may optionally be employed to verify that the forwardmost coupon has been successfully delivered to its target. This signal may be based on photocell detection of an exiting coupon or even on a sonic sensor which detects arrival of a coupon within a container.

In the preferred embodiment, the signal supplied by preset counter 105 on line 101 corresponds to the number of coupons contained in the web. The controller 92 may also supply a signal to decrement the preset counter 105 on a line 109 upon the execution of a burst sequence. In addition, the controller 92 may supply an output signal to a counter 111 on a line 113 to indicate the total number of delivered coupons.

The signal on line 100 is a variable frequency signal that is passed to a frequency-to-analog converter 104. The frequency-to-analog converter 104 converts the signal received on line 100 to a voltage output signal on a line 106. This output voltage signal is supplied via an RC network 108 to an analog-to-frequency converter 100 on a line 112. The output of the analog-to-frequency converter 110 is supplied on a line 114 to the input of stepper motor 52. This is the signal which controls the rotation of stepper motor output shaft 54 and hence the rotation of the feed roll subassembly 21. Likewise, in a first mode of operation, this signal controls rotation of the burst roll drive shaft 39 and the burst roll subassembly. While the present best mode for practicing the invention contemplates use of frequency to analog and analog to frequency conversion for generating output pulses for controlling the stepper motor 52 due to the variable frequency output limitations of electronic controller 90, it should be understood that such conversion would not necessarily be required where a controller with greater frequency output range is utilized, or where a stepper motor with lower driving pulse requirements is used. Likewise, the use of an RC network to insure that the output pulses supplied to the stepper motor are ramped to a desired frequency is specific to this particular implementation of the invention.

A clutch control signal on a line 102 regulates the torque transfer from the clutch input 80 shaft to the output shaft 84. Accordingly, when the controller 90 provides a clutch control signal on line 102 to engage the clutch 82, such as for performing a burst operation, the constant motor 70 transmits torque to the lower burst roll 38 via drive shaft 39. Otherwise, the clutch 82 is disengaged.

Figure 6:
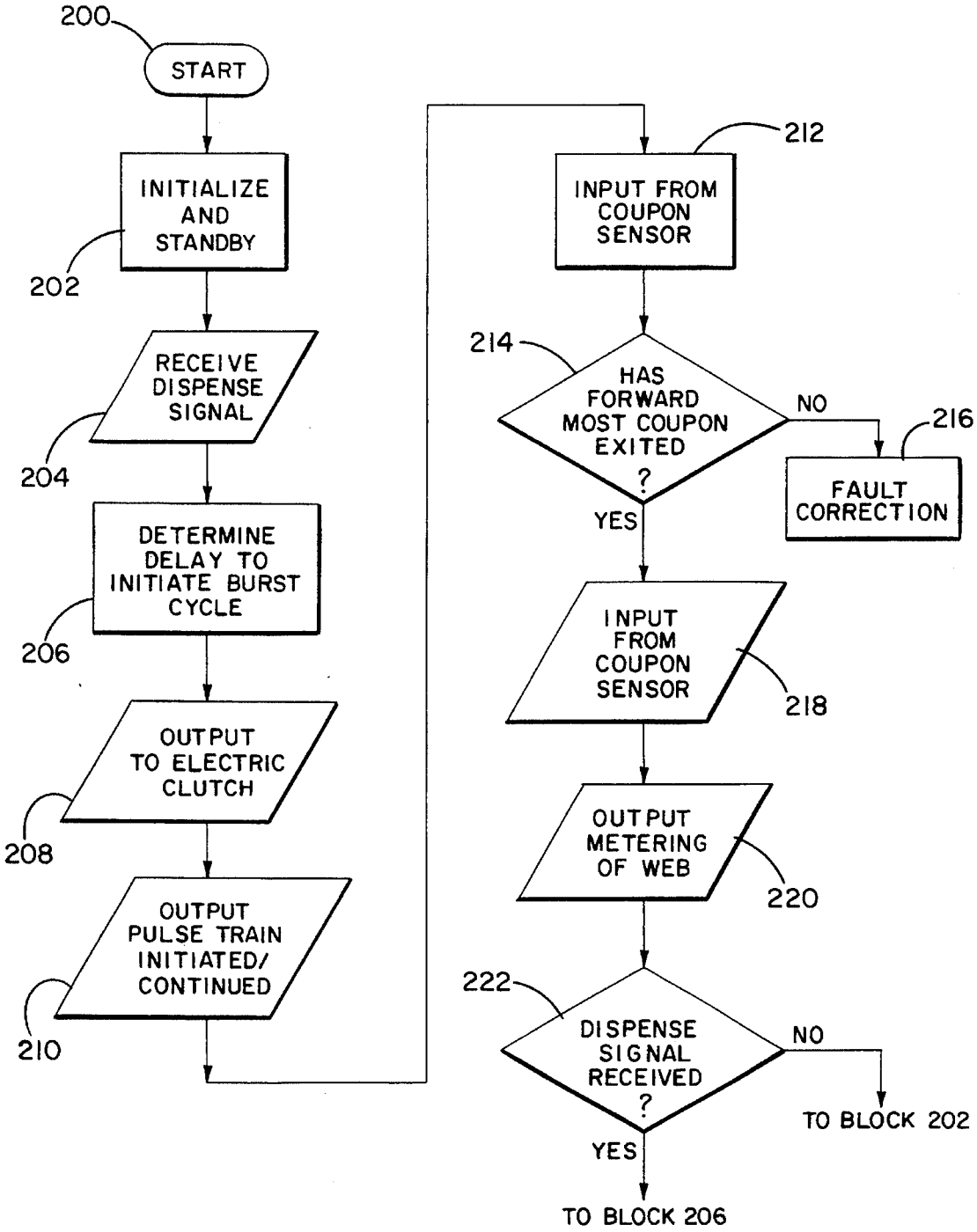
FIG. 6 is a flow chart illustrating a control sequence performed by the control circuitry of FIG. 5.

FIG. 6 is a logical flow chart for system operation of a coupon inserter assembly according to the present invention. As shown, the system begins at a start block 200 wherein the forwardmost coupon is located in a burst position, that is, the forwardmost coupon is engaged in the nip formed between the burst rolls with the weakened web portion separating the forwardmost coupon and the next succeeding coupon located between the feed rolls and the burst rolls. The system then advances to a next block 202 at which initial conditions are set. Specifically, the system initializes parameters for motion and timing calculations for delivery of a coupon of a specific length at a desired rate, and monitoring of system inputs and outputs. The system may also receive an input signal from the photosensor 48 to verify that the forwardmost coupon is located in the burst position described above. At block 202, the system also selects an appropriate operational mode, i.e., either a continuous feed mode or a start-stop feed mode. In a continuous feed mode, the system operates to advance the string of coupons in a continuous fashion during both a feed operation and a burst operation. During a startstop mode, the string of coupons is intermittently supplied depending on the production line speed.

At a next block 204, the system receives the input signal to dispense the forwardmost coupon into a target container. The system thereafter processes this signal at a block 206 and determines the appropriate time for dispensing the forwardmost coupon into the container. The system thereafter provides an output signal to engage the electronic clutch 82 (see FIG. 5) at a block 208. The electronic clutch is engaged for a preselected time interval to couple the high-speed constant motor with the burst roll drive shaft and thereby rotate the burst rolls at an increased angular velocity. During this operation, the burst rolls rotate at a tangential velocity greater than the tangential velocity of the feed rolls and the velocity of the web. Accordingly, a bursting tension will develop in the separable web portion between the forwardmost coupon and the next succeeding coupon upon engagement of the constant speed drive. In this way, the forwardmost coupon separates from the web and exits the assembly at a velocity determined by the tangential speed of the burst rolls.

After a preselected delay, the system advances to a block 210 and initiates, or in the case of a continuous operational mode continues, feeding of the web at a rate determined by the operational mode selected and the production line speed. The feed rate is based on the number of pulses output to the stepper motor 52. The system thereafter advances to a next block 212 where it obtains an input signal from photosensor 48 (see FIG. 5). At a decision block 214, the system determines whether the forwardmost coupon has exited the burst rolls. If no, the system advances to a block 216 and takes appropriate corrective action. If yes, the system advances to a next block 218.

At block 218, the system again obtains an input signal from the photosensor 48 indicative of arrival of the leading edge of the web. The system then advances to a block 220 and meters advancement of the web. In particular, the system supplies a selected number of output pulses to the stepper motor 52 required to position the forwardmost coupon at the burst location at a time when a burst operation will be performed.

The system then advances to a decision block 222 and determines whether a dispense signal is received. If yes, the system then branches back to the Initiate Burst Cycle block 206 and repeats. If no, the system branches to the Initialize and Standby block 202 after the selected coupon length is metered.

In an alternative embodiment according to the present invention for actuating the feed rolls and the burst rolls, an electric clutch/brake arrangement is employed in place of the stepper motor 52 in the embodiment described above. In this embodiment, the output of constant electric motor 70 is connected to the input of the clutch brake and the lower feed roll drive shaft is connected to the output of the clutch brake via appropriate coupling. The remaining mechanical couplings described above remain the same.

The electronic controller 92 is likewise electrically coupled to the clutch/brake arrangement and provides a first command signal thereto for engaging the clutch so that torque is transferred between the constant speed motor and the feed roll drive shaft. In addition, the electronic controller provides a second command signal to the clutch/brake arrangement to engage the electric brake for decoupling the constant speed electric from the feed roll drive shaft. Accordingly, during a feed operation, the controller 92 provides a command signal, at an appropriate time, for engaging the clutch and disengaging the brake of the clutch/brake for rotating the feed rolls at a constant rate. In this mode, the burst rolls are likewise rotated at the same constant rate as described above. Thus, the feed rolls and the burst rolls cooperate to feed the forwardmost coupon to the predispense position. In a burst operation, the controller provides a signal for engaging the brake and for disengaging the clutch of the clutch/brake to stop rotation of the feed rolls. Since the burst rolls are coupled with the constant electric motor 70 via electric clutch 82, engagement of clutch 82 provides torque transfer to rotate the burst rolls and separate the forwardmost coupon from the remainder of the web.

As noted above, the upper feed roll and upper burst roll arrangements are mounted to removable housing module 12*a*, while the lower feed rolls and burst rolls are mounted to removable housing module 12*b*. Thus, the particular feed roll and burst roll configurations may be readily modified depending on the particular application simply by interchanging the housing modules 12*a–b*. Similarly, the tensioning rolls 18 and 20 may be readily removed by removing the housing module 12*d*.

As set forth above, an improved high speed coupon inserter system and method of using the same has been described. Various interconnections and modifications as would be apparent to one of ordinary skilled in the art and familiar with the teaching of this application are deemed to be within the scope of this invention. For example, rather than comparing the train of output pulses supplied to the stepper motor with a known number of pulses, as shown in decision block 210 of FIG. 6, the system could also set a timer for the time at which a burst operation occurs. Likewise, those skilled in the art will appreciate that an output accelerator or other coupon delivery arrangement, such as one disclosed in the aforesaid applications, may be used to receive the separated coupons and deliver the separated coupons to containers at a selected speed. Thus, the precise scope of the invention is set forth in the appended claims, which are made, by reference, a part of this disclosure.

Various advantages flow readily from the disclosed inserter designed and corresponding method of using the same. For example, the above described feeding and bursting operations may be repeated in a continuous fashion to provide a dramatic increase in the coupon insertion rate and to achieve better overall efficiency in the same commercial environment. That is, where a previous system may employ slower coupon handling speeds and accompanying production line speeds, the present invention can provide that same coverage, in reduced time. Further, the novel feed roller and burst roller structure for processing the coupons enables use of various three dimensional configurations.

Accordingly, both the structure and the method of using the present invention provides significant improvements over the prior art, improvements that are manifested both in increased performance and diminished cost.

What is claimed is:

1. Apparatus for delivering successive coupons to a dispensing location, said coupons being provided as a continuous web of successive coupons with a forwardmost coupon having its trailing edge connected to the leading edge of the next coupon by a weakened web portion, each successive coupon being similarly connected in said web, the apparatus comprising:

feed roll means for engaging the continuous web of coupons and for passing the coupons downstream;

burst roll means located downstream from said feed roll means for receiving the forwardmost coupon in a nip formed between the burst roll means;

control means responsive to a timing signal related to the time when the forwardmost coupon is to be positioned at said dispensing location, for providing a sensing signal related to the presence of a coupon at a sensing position between said feed roll means and said burst roll means, for providing a first output signal in response to said timing signal and said sensing signal, and for providing a second output signal in response to said timing signal; and actuating means including first drive means coupled with said feed roll means and said burst roll means, second drive means coupled with said burst roll means, and means for decoupling said second drive means from said burst roll means in a first mode of operation and for decoupling said first drive means from said burst roll means in a second mode of operation, said actuating means rotating said feed roll means and said burst roll means at a first angular speed in response to said first output signal in the first mode of operation and rotating said feed roll means at said first angular speed and said burst roll means at a second angular speed in response to said second output signal to thereby separate the forwardmost coupon engaged in said burst roll means from the continuous web and deliver the forwardmost coupon to said dispensing location in the second mode of operation.

2. The coupon inserting apparatus of claim 1 wherein said first drive means comprises a stepper motor.

3. The coupon inserting apparatus of claim 1 wherein said second drive means rotates said burst roll means at a constant angular speed.

4. The invention as in claim 1 wherein said feed roll means comprises:

first and second upper feed rolls located proximate a lower feed roll, said first and second upper feed rolls being axially spaced from each other to define a feed roll space therebetween, each of said upper feed rolls including a peripheral surface engaging a first portion of the continuous web of coupons in a nip formed between said peripheral surface and said lower feed roll while permitting a second portion of the continuous web of coupons to pass through said feed roll space.

5. The invention as in claim 1 wherein said burst roll means comprises:

first and second upper burst rolls located proximate a lower burst roll, said first and second upper burst rolls being axially spaced from each other to define a burst roll space therebetween, each of said upper burst rolls including a peripheral surface engaging a first portion of the forwardmost coupon in a nip formed between said peripheral surface and said lower burst roll while permitting a second portion of the forwardmost coupon to pass through said feed roll space.

6. Apparatus for positioning coupons into moving containers in a continuous fashion as the containers pass a dispensing location, the coupons provided in a continuous web wherein the trailing edge of a forwardmost coupon is connected to the leading edge of a successive coupon with a separable portion, the apparatus comprising:

a bursting subassembly including first and second opposed burst rolls, at least one of the opposed burst rolls selectively coupled with a first drive source and a second drive source, the opposed burst rolls disposed to engage each of the successive coupons and, in a first operable mode, said at least one of the opposed burst rolls being coupled with the first drive source to advance the first coupon, and in a second operable mode, being coupled with the second drive source to separate the trailing edge of the first coupon from the leading edge of the successive coupon along the separable portion;

a coupon feeding subassembly including first and second opposed feed rolls, at least one of the opposed feed rolls coupled with the first drive source, the opposed feed rolls disposed to engage each of the successive coupons and, in the first operable mode, advancing the coupons in cooperation with the bursting subassembly, and in the second operable mode, engaging the successive coupon while the first coupon is separated by the bursting subassembly;

a coupon position sensor located between the coupon feeding subassembly and the bursting subassembly for sensing the presence of the forwardmost coupon and providing a first sensing signal; and a control circuit providing a timing signal related to the time when the coupon is to be positioned into a container when the container passes the dispensing location, and receiving the first sensing signal from the coupon position sensor, the control circuit providing a first output signal in response to the timing signal and the first sensing signal to operate the first drive source in the first and second operable modes and for providing a second output signal in response to the timing signal to selectively couple the bursting subassembly with the second drive source in the second operable mode.

7. The invention as in claim 6 wherein the coupon position sensor provides a second sensing signal to the control circuit when the forwardmost coupon is separated from the web.

8. The invention as in claim 6 wherein the control circuit receives a verification signal from an external source upon the insertion of the forwardmost into a container.

9. The invention as in claim 6 wherein the coupons are three-dimensional inserts.

10. The invention as in claim 6 wherein said coupon feeding subassembly comprises:

a third feed roll axially spaced from the first feed roll, the first and third feed rolls being axially adjustable relative to each other to define a feed roll space therebetween, each of the first and third feed rolls including a peripheral surface engaging a first section of the continuous web of coupons in a nip formed between the peripheral surface and the second feed roll while permitting a second section of the continuous web of coupons to pass through the feed roll space.

11. The invention as in claim 10 wherein the second section of the continuous web has at least portions thereof raised with respect to the first section of the continuous web.

12. The invention of claim 6 wherein the first feed roll is freely rotatable and the second feed roll is coupled with the first drive source.

13. The invention of claim 6 wherein the first burst roll is freely rotatable and the second burst roll is selectively coupled with the first drive source and the second drive source.

14. The invention as in claim 6 wherein said bursting subassembly comprises:

a third burst roll axially spaced from the first burst roll, the first and third burst rolls being axially adjustable relative to each other to define a burst roll space therebetween, each of the first and third burst rolls including a peripheral surface engaging a first portion of the forwardmost coupon in a nip formed between the peripheral surface and the second burst roll while permitting a second portion of the forwardmost coupon to pass through the burst roll space.

15. The invention as in claim 14 wherein the second portion of the continuous web has at least portions thereof raised with respect to the first portion of the continuous web.

16. Apparatus for delivering successive coupons to successive containers at a dispensing location, said coupons being provided as a continuous web of successive coupons with a forwardmost coupon having its trailing edge connected to the leading edge of the next coupon by a weakened web portion, each successive coupon being similarly connected in said web, the apparatus comprising:

feed roll means operable in a noninterrupted fashion to engage the continuous web of coupons and to pass the coupons downstream;

burst roll means located downstream from said feed roll means for engaging the forwardmost coupon;

a control circuit responsive to a plurality of timing signals supplied from an external source, each of said timing signals related to the time when the forwardmost coupon is to be positioned in one of the containers as it passes the dispensing location, said control circuit providing a plurality of sensing signals, each of said sensing signals related to the presence of a coupon at a sensing position between said feed roll means and said burst roll means, said control circuit generating a first series of output pulses of a variable frequency in response to said timing signal and said sensing signal, and providing a plurality of second output signals in response to said timing signals; and an actuating subassembly operable in a first mode to rotate said feed roll means and said burst roll means in response to said first series of output pulses and operable in a second mode to rotate said burst roll means at a first angular speed in response to one of said second output signals while said feed roll means is rotated at a second angular speed less than said first angular speed in response to said first series of output pulses to thereby separate the forwardmost coupon engaged in said burst roll means from the continuous web and deliver the forwardmost coupon to one of the containers as it passes the dispensing location, said actuating subassembly thereafter continuously rotating said feed roll means to move the next succeeding coupon to said sensing position in response to said first series of output pulses.

17. The invention of claim 16 wherein the actuating subassembly comprises:

a first drive source coupled with said feed roll means and said burst roll means;

a second drive source coupled with said burst roll means;

means for decoupling said second drive source from said burst roll means in said first mode; and means for decoupling said first drive source from said burst roll means in said second mode.

18. The invention of claim 16 wherein the coupons are three-dimensional inserts.

19. The invention as in claim 16 wherein the control circuit provides at least one of said sensing signals when the forwardmost coupon is separated from the web.

20. The invention as in claim 16 wherein the control circuit receives a verification signal from an external source upon the insertion of the forwardmost into a container.

21. The coupon inserting apparatus of claim 16 wherein said burst roll means comprises:

first and second upper burst rolls located proximate a lower burst roll, said first and second upper burst rolls being axially spaced from each other to define a burst roll space therebetween, each of said upper burst rolls including a peripheral surface engaging a first portion of the forwardmost coupon in a nip formed between said peripheral surface and said lower burst roll while permitting a second portion of the forwardmost coupon to pass through said burst roll space.

22. The coupon inserting apparatus of claim 16 wherein said feed roll means comprises:

first and second upper feed rolls located proximate a lower feed roll, said first and second upper feed rolls being spaced from each other to define a feed roll space therebetween, each of said upper feed rolls including a peripheral surface engaging a first portion of the continuous web of coupons in a nip formed between said peripheral surface and said lower feed roll while permitting a second portion of the continuous web of coupons to pass through said feed roll space.

23. The invention as in claim 22 wherein the second portion of the continuous web has at least portions thereof raised with respect to the first portion of the continuous web.

* * * * *